US006041892A

United States Patent [19]

Watanabe et al.

[11] Patent Number: 6,041,892

[45] Date of Patent: Mar. 28, 2000

[54] OIL PUMP FOR OUTBOARD MOTOR

[75] Inventors: Hitoshi Watanabe; Masanori Takahashi; Noriyoshi Hiraoka, all of Hamamatsu, Japan

[73] Assignee: Sanshin Kogyo Kabushiki Kaisha, Hamamatsu, Japan

[21] Appl. No.: 08/996,529

[22] Filed: Dec. 23, 1997

[30] Foreign Application Priority Data

Dec. 24, 1996 [JP] Japan ..... 8-343997
Aug. 25, 1997 [JP] Japan ..... 9-227878

[51] Int. Cl.[7] ..... F01M 11/00

[52] U.S. Cl. ..... 184/6.28; 184/27.1; 440/88; 123/196 W

[58] Field of Search ..... 184/27.1, 26, 31, 184/6.5, 6.28; 440/88, 64, 75; 123/196 W, 196 R, 195 P

[56] References Cited

U.S. PATENT DOCUMENTS 3,431,882 3/1969 Irgens ..... 440/52
4,372,258 2/1983 Iwai .
4,493,661 1/1985 Iwai .
4,766,859 8/1988 Miyaki et al. .
4,828,519 5/1989 Watanabe .
5,215,164 6/1993 Shibata ..... 184/6.13
5,687,686 11/1997 Takahashi .
5,701,872 12/1997 Kaku et al. .
5,704,819 1/1998 Isogawa .
5,873,755 2/1999 Takahashi et al. ..... 440/77
5,876,188 3/1999 Okamoto ..... 417/364

*Primary Examiner*—Tamara L. Graysay
*Assistant Examiner*—David M. Fenstermacher
*Attorney, Agent, or Firm*—Knobbe, Martens, Olosn & Bear LLP

[57] ABSTRACT

An oil pump for a lubricating system of an outboard motor is disclosed. The motor has a cowling defining an engine compartment, a water propulsion device, and a guide member having an upper surface and a lower surface, the guide member positioned in the cowling and generally dividing the engine compartment into an upper part and a lower part. An engine is positioned in the upper part of the engine compartment within the cowling and has an output shaft arranged to drive the water propulsion device. The lubricating system includes an oil pan positioned below the guide member and an oil passage leading from the pan through the guide member. The oil pump is positioned in the upper part of the engine compartment, but below the engine, and is driven by a lower end of the output shaft of the engine which extends below the engine, the oil pump having an oil inlet in communication with the oil passage through the guide member.

14 Claims, 16 Drawing Sheets

OIL PUMP FOR OUTBOARD MOTOR

FIELD OF THE INVENTION

The present invention relates to an oil pump. More particularly, the invention is an oil pump arrangement for an outboard motor having a water propulsion device powered by an internal combustion engine positioned in a cowling of the motor.

BACKGROUND OF THE INVENTION

Outboard motors are powered by an engine which is positioned within a cowling of the motor. The engine includes an output shaft which extends downwardly therefrom and is arranged to drive a drive shaft. The drive shaft extends to a lower portion of the motor, where it is arranged to drive a water propulsion device of the motor, such as a propeller.

These motors include a lubricating system for providing lubricant to the engine. The lubricating system typically includes an oil pan and an oil pump for drawing oil from the pan and delivering through passages or galleries through the engine.

The oil pump is often driven off of a camshaft of the engine. A disadvantage of this arrangement is that the oil pump is driven at half the speed of the output shaft, and thus at a fairly low speed. In order for the pump to supply the necessary quantity of oil, the oil pump must then be much larger to compensate for its lower drive speed. The enlarge sized of the oil pump conflicts with the desire to keep the engine, and thus the cowling in which the engine is positioned, as small as possible.

An improved oil pump arrangement for an outboard motor of the type having an engine powering a water propulsion device, is desired.

SUMMARY OF THE INVENTION

In accordance with the present invention, there is provided an oil pump for a lubricating system of an outboard motor.

The motor is preferably of the type which has a cowling defining an engine compartment and includes a guide member having an upper surface and a lower surface, the guide member positioned in the cowling and generally dividing the engine compartment into an upper part and a lower part. The motor includes a water propulsion device. An engine is positioned in the upper part of the engine compartment within the cowling and has an output shaft arranged to drive the water propulsion device.

The lubricating system includes an oil pan positioned below the guide member and an oil passage leading from the pan through the guide member. The oil pump is positioned in the upper part of the engine compartment and is driven by the output shaft of the engine, the oil pump having an oil inlet in communication with the oil passage through the guide member.

In a preferred arrangement, a connecting member is positioned at an end of the output shaft of the engine. The connecting member is connected to the oil pump for driving the oil pump. A drive shaft extends from the connecting part through the oil pump downwardly through the motor for driving the water propulsion device.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
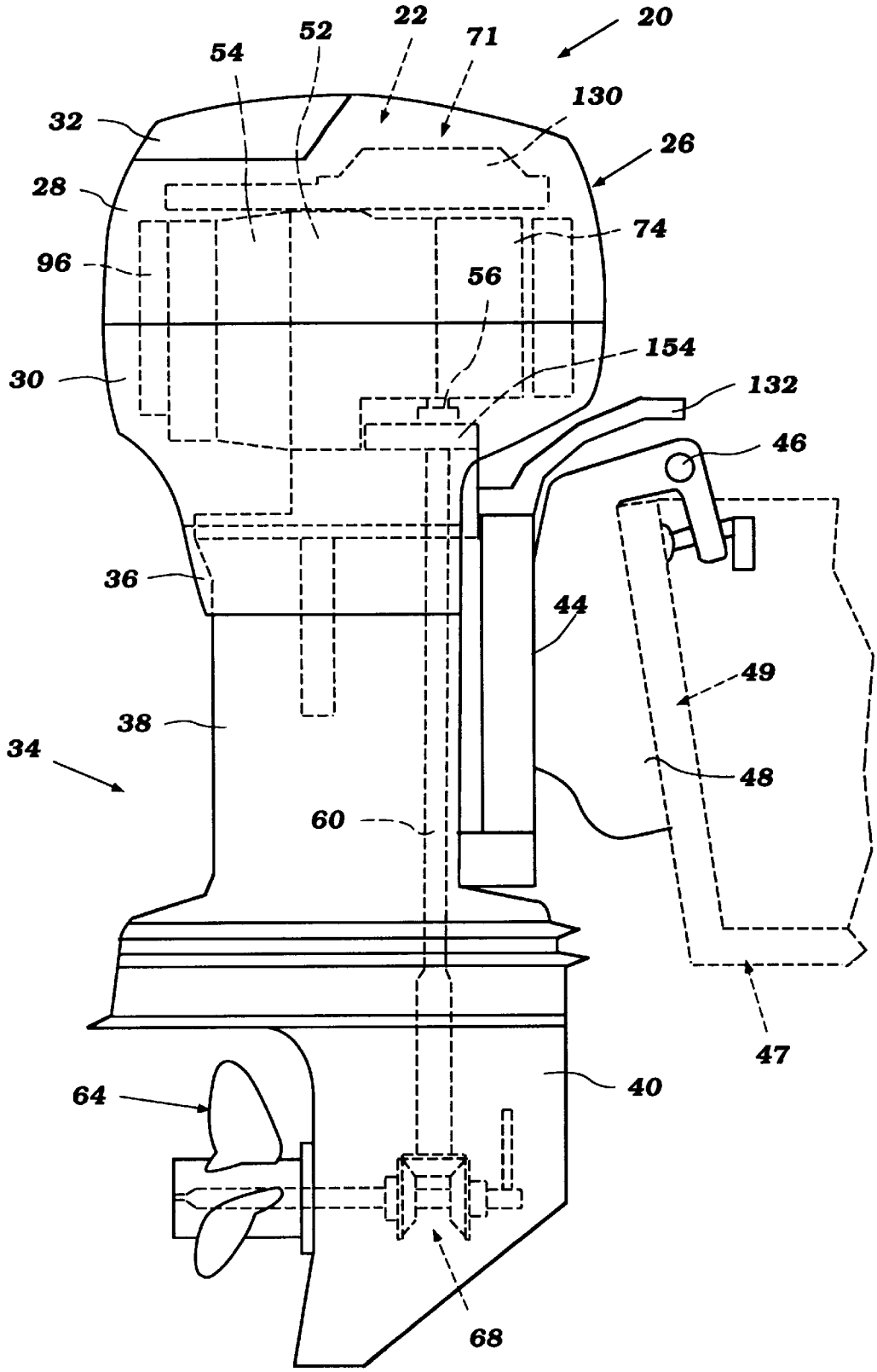
FIG. 1 is a side view of an outboard motor having a water propulsion device powered by an engine positioned in a cowling of the motor and having an oil pump in accordance with the present invention.

In accordance with the present invention there is provided an oil or lubricating pump for a lubricating system of an outboard motor 20 such as that illustrated generally in FIG. 1, the motor having a water propulsion device powered by an internal combustion engine positioned in a cowling of the motor. The oil pump of the present invention is described for in conjunction with a lubricating system of an outboard motor having an engine positioned in a cowling thereof since this is an application for which the system has particular advantages. Those of skill in the art will appreciate that the oil pump arrangement may be adapted for use in a variety of other applications.

Referring to FIG. 1, the outboard motor 20 has a main cowling 26 comprised of an upper cowling 28 and a lower cowling 30. An engine 22 is positioned in the main cowling 26 of the motor 20. An air inlet or intake vent 32 is provided in the main cowling 26 for providing air to the engine 22 therein. The motor 20 includes a lower unit 34 extending downwardly from the main cowling 26. The lower unit 34 comprises an upper or "drive shaft housing" section 38 and a lower section 40. A skirt 36 generally defines the intersection between the main cowling 26 and the lower unit 34.

The motor 20 is arranged to be movably mounted to a watercraft 47. Preferably, the motor 20 is connected to a steering shaft (not shown). The steering shaft is supported for steering movement about a vertically extending axis within a swivel or swivel bracket 44. The mounting of the motor 20 via the steering shaft with respect to the swivel bracket 44 permits the motor 20 to be rotated about the vertically extending axis through the swivel bracket 44. In this manner, the motor 20 may be turned to direct the watercraft which it is used to propel.

The swivel bracket 44 is connected by means of a pivot pin 46 to a clamping bracket 48 which is adapted to be attached to a transom portion of a hull 49 of the watercraft 47. The pivot pin 46 permits the outboard motor 20 to be trimmed and tilted up about the horizontally disposed axis formed by the pivot pin 46.

Figure 2:
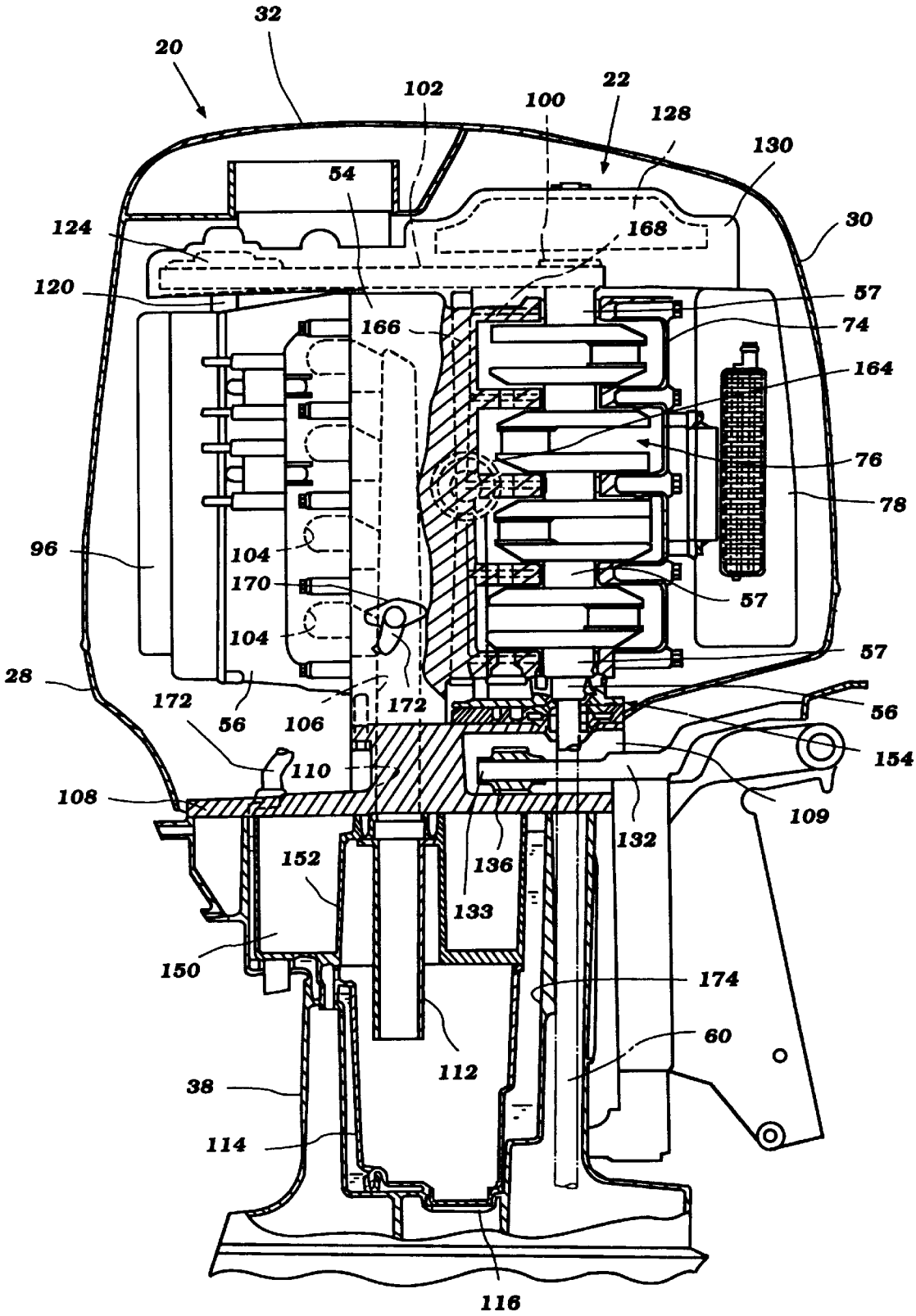
FIG. 2 is a cross-sectional side view of a powerhead portion of a motor such as that illustrated in FIG. 1 as including an oil pump of a lubricating system of the motor in accordance with a first embodiment of the present invention.
Figure 3:
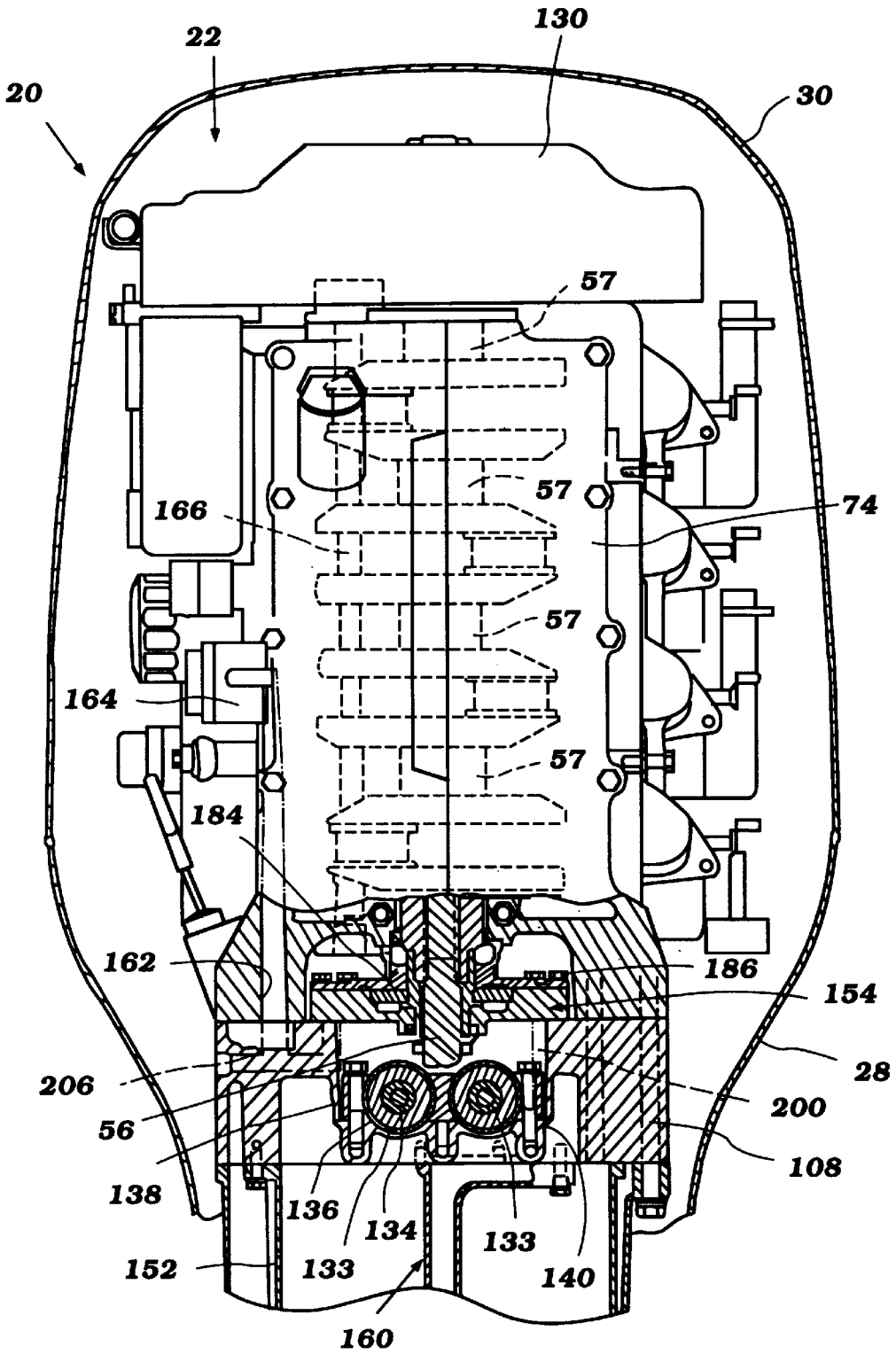
FIG. 3 is a cross-sectional end view of the powerhead portion of the motor illustrated in FIG. 1.

With reference to FIG. 2, the steering shaft is preferably connected at its top end to a steering tiller or handle 132. Referring to FIG. 3, the handle 132 has a bifurcated end in the form of pair of spaced rods 133 which are each positioned in a bushing 134. Each bushing 134, in turn, is positioned in an elastomer 136. A retainer plate 138 extends around a top part of the elastomer 136 and is maintained in place with one or more fasteners 140 which engage the plate 138 and an exhaust guide 108 (described in more detail below).

Referring to FIGS. 1–4, the engine 22 is preferably of the four-cylinder variety, arranged in in-line fashion and operating on a four-cycle operating principle. As may be appreciated by those of skill in the art, the engine 22 may have a greater or lesser number of cylinders, such as two, six, or eight or more. In addition, the engine 22 may have its cylinders arranged in "V," opposing or other arrangements, and the engine 22 may operate on a two-cycle or other principle.

Figure 4:
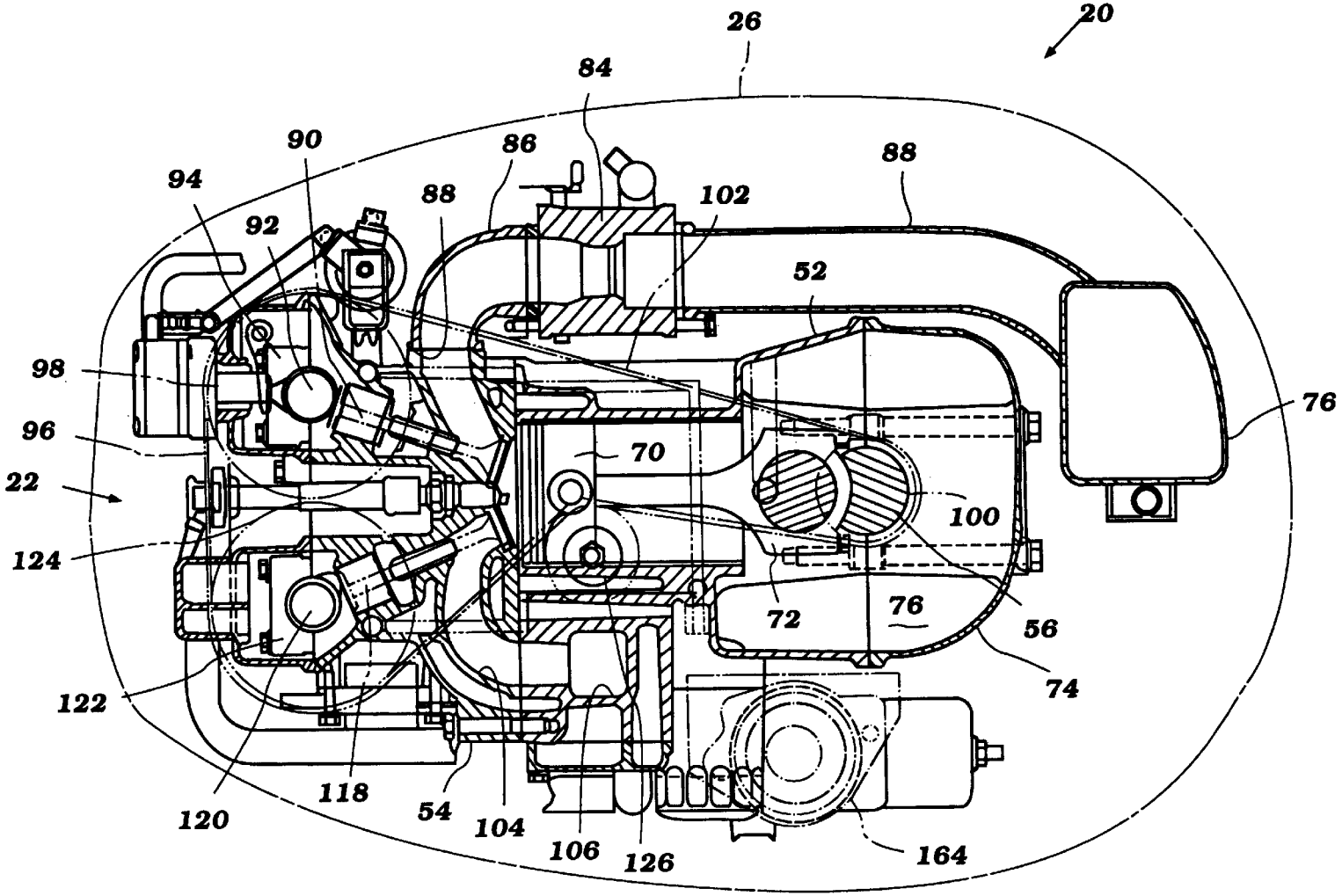
FIG. 4 is a cross-sectional top view of the motor and engine illustrated in FIG. 1.

In the preferred arrangement, and referring to FIGS. 1 and 4, the engine 22 has a cylinder block 52 with a cylinder head 54 connected thereto and cooperating therewith to define the four cylinders. A piston 70 is movably positioned in each cylinder, and connected to a connecting rod 72 extending to a vertically extending crankshaft 56. Referring to FIG. 1, the crankshaft 56 is arranged to drive a drive shaft 60 which extends downwardly through the lower unit 34, where it is arranged to drive a water propulsion device of the motor 20.

Preferably, this water propulsion device comprises a propeller 64. The propeller 64 is connected to a propeller shaft 66 and preferably driven by the drive shaft 60 through a conventional forward-neutral-reverse transmission 68. The transmission is not illustrated in detail and may be of a variety of types known to those of skill in the art. A control is preferably provided for allowing an operator to remotely control the transmission, such as from the watercraft.

The crankshaft 56 has a number of bearing support portions 57 journaled for rotation with respect to the cylinder block 52. A crankcase cover 74 engages an end of the block 52, defining therewith a crankcase chamber 76 within which the crankshaft rotates. The crankcase cover 74 is preferably attached to the cylinder block 52 by bolts or similar means for attaching as known to those skilled in the art.

The engine 22 includes an air intake system. Air is drawn through into an engine compartment 71 defined by the cowling 26 through the vent 32. The air is then drawn through a filtered inlet into a silencer or air box 78. As illustrated, the air box 78 is mounted at an end of the engine 22 which is closest to the watercraft 47.

Air is routed from the air box 78 through a runner 80 which extends along a side of the engine 22. The runner 80 preferably extends to a carburetor 82 which is described in more detail below. A passage through an intake manifold 86 extends from the carburetor 82 to an intake passage 88 leading through the cylinder head 54 to a cylinder.

Preferably, and as best illustrated in FIG. 3, a runner 80 and carburetor 82 are provided for each cylinder, and the intake manifold 86 defines a passage therethrough corresponding to each cylinder.

Means are provided for controlling the flow of air into each cylinder. Preferably, and referring to FIG. 4, this means comprises an intake valve 90 movably positioned in each intake passage 88. Means are also provided for moving each valve 90 between a first position in which the valve prevents air from flowing through the intake passage 88 into the cylinder, and a second position in which air may flow into the cylinder. Preferably, this means comprises an intake camshaft 92. The intake camshaft 92 is rotatably connected to the cylinder head 54 with one or more brackets 94. The intake camshaft 92 is arranged to operate the valve 90 corresponding to each cylinder. As illustrated, the intake camshaft 92 is covered by a cover 96 which is attached to the cylinder head 54.

Means are provided for rotating the intake camshaft 92 for actuating the valves 90. As illustrated in FIG. 4, a drive pulley 100 is mounted on a top end of the crankshaft 56 which extends above a top end of the engine 22. Likewise, a driven pulley 98 is mounted to a top end of the intake camshaft 92 which extends through the cover 96 at the top end of the engine 22. A flexible transmitter, preferably a belt 102, engages the drive and driven pulleys 100, 98, whereby the crankshaft 56 drives the camshaft 92.

The engine 22 includes a fuel system for providing fuel to the engine for combustion with the air. Preferably, each carburetor 82 is arranged to deliver fuel into the air flowing therethrough for creating air/fuel charge which is delivered to each cylinder. Those of skill in the art will appreciate that other charge formers may be used, such as fuel injectors which inject fuel into air passing through the intake system or directly into the cylinder. Such fuel systems are well known in the art.

A suitable ignition system is provided for igniting the air and fuel mixture in each cylinder. Such systems are well known to those skilled in the art, and as such form no part of the invention herein, such is not described in detail here.

An exhaust system is provided for routing the products of combustion from the engine 22. Referring to FIG. 4, an exhaust passage 104 leads through the cylinder head 54 from each cylinder. Each exhaust passage 104 leads to a common exhaust passage 106 defined by the cylinder block 52 and leading to a bottom end of the engine 22.

Referring now to FIG. 2, an exhaust guide 108 is positioned at the bottom end of the engine 22. The exhaust guide 108 generally separates an engine compartment 71 defined by the cowling 26 from that space defined by the drive shaft housing 38 of the lower unit 34. As illustrated in FIG. 2, the exhaust guide 108 preferably defines a space 109 between a top portion which is adjacent the engine 22 and a bottom portion which is just above the an oil pan 152 (described in more detail below). The steering handle 132 preferably extends into this space 109 to the elastomer mounting.

A passage 110 extends through the exhaust guide 108 and is aligned with the exhaust passage 106 through the cylinder block 52. An exhaust pipe 112 extends downwardly from the exhaust guide 108 on the side opposite the engine 22. The exhaust pipe 112 extends into an exhaust muffler 114 located in the drive shaft housing 38. A discharge passage 116 extends through a wall defining the muffler 114 generally opposite the exhaust pipe 112. The discharge passage 116 leads to a through-the-hub exhaust discharge through which exhaust is routed to a point external to the motor 20.

Means are provided for controlling the flow of exhaust from each cylinder in a timed manner. Preferably, this means comprises an exhaust valve 118 positioned in each exhaust passage 104, as illustrated in FIG. 4. Each exhaust valve 118 is movable between a first position in which the exhaust passage 104 is blocked and prevents the flow of exhaust from the cylinder to the common exhaust passage 106, and a second position in which exhaust may flow from the cylinder to the exhaust passage 106.

Means are provided for actuating each exhaust valve 118. Preferably, this means comprises an exhaust camshaft 120. The exhaust camshaft 120 is rotatably connected to the cylinder head 54 with one or more brackets 122, and preferably positioned under the cover 96. Preferably, the exhaust camshaft 120 is driven by the same belt 102 which drives the intake camshaft 92. As illustrated, a driven pulley 124 is mounted to a portion of the exhaust camshaft 120 extending above the top end of the engine 22.

Referring to FIG. 4, a tensioner pulley 126 is preferably provided for maintaining the belt 102 in a taut condition.

Referring to FIG. 2, a flywheel 128 is preferably connected to the top end of the crankshaft 56 above the drive pulley 100. The flywheel 128 may be used in a pulser-coil type arrangement for generating electricity for firing the ignition elements, and for providing a firing timing for the ignition elements, as is well known to those of skill in the art. Preferably, the flywheel 128 and the camshaft drive is positioned under a cover 130 extending over the top end of the engine 22 below the upper cowling 30.

The motor 20 includes a lubricating system for providing lubricant to one or more portions thereof. As used herein, the terms "oil" and "lubricant" are meant to be equivalent, meaning natural petroleum oil, synthetic lubricants and/or mixtures thereof.

Figure 5:
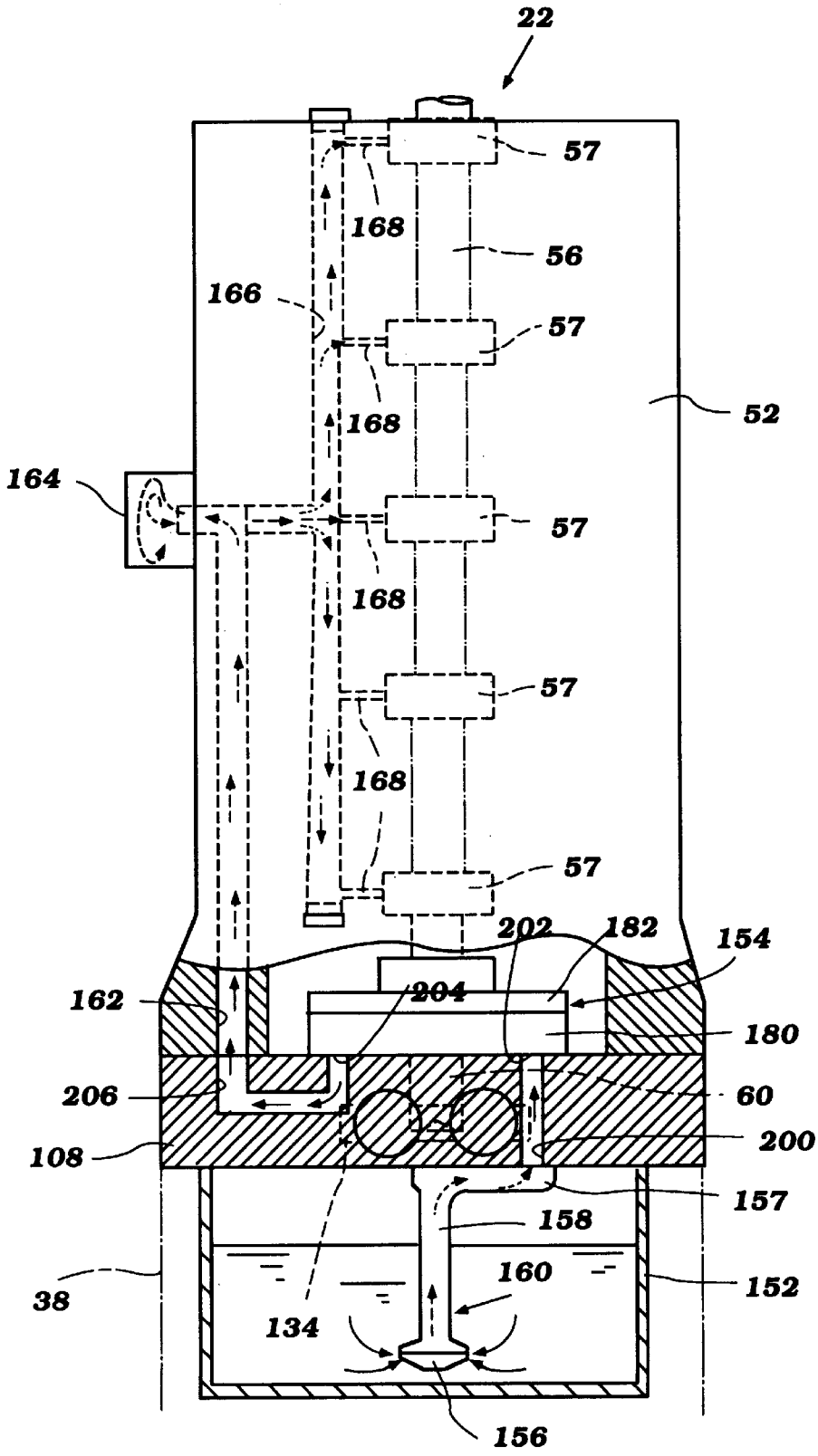
FIG. 5 is a partial cross-sectional view of the engine illustrated in FIG. 1, illustrating a lubricant flow path of a lubricating system of the motor.

The lubricating system includes a lubricant supply. As illustrated in FIGS. 2 and 5, this supply comprises a lubricant or oil tank 150 which is defined by a wall 152 and positioned below the exhaust guide 108. Means are provided for drawing lubricant from the tank 150 and delivering it to one or more passages to the engine 22. Preferably, this means comprises an oil pump 154, described in greater detail below.

The pump 154 draws lubricant from the tank through a screen 156 positioned at an end of a tube 158 of an oil pick-up 160. The tube 158 leads upwardly towards the exhaust guide 108, and then along a leg section 157 generally along a bottom surface of the guide 108 to an inlet passage (described in more detail below).

The pump 160 delivers the lubricant through a main passage 162 which extends through the cylinder block 52 to a filter 164. The lubricant 164 then flows through a main gallery 166 to sub-galleries 168 for lubricating the crankshaft bearings and bearing support parts 57, as illustrated in FIG. 5. The lubricant is preferably also delivered through one or more galleries or passages (not shown) for lubricating the camshafts 92, 120 and other portions of the engine as well known to those skilled in the art. The lubricant is then arranged to flow, with the aid of gravity, downwardly through one or more drain passages back into the lubricant tank 150.

Preferably, the motor 20 includes a cooling system. Such systems are well known to those of skill in the art, and as such forms no part of the invention, such is not described in detail herein. Preferably, however, the cooling system is arranged to draw cooling water from the body of water in which the motor 20 is operating and distribute it to one or more cooling jackets or passages through the engine 22. As best illustrated in FIG. 2, this coolant may flow through a coolant drain 170 from an exhaust manifold cooling jacket area, and then through a drain hose 172 to a coolant pool 174. Preferably, the coolant pool 174 is defined by a wall spaced from the wall 152 defining the lubricant tank 150 and the wall defining the exhaust muffler 174. In this manner, the coolant pool 174 cools the exhaust and the lubricant in the lubricant tank 152. The coolant is arranged to flow from the pool 174 to a point external to the motor 20.

Figure 6:
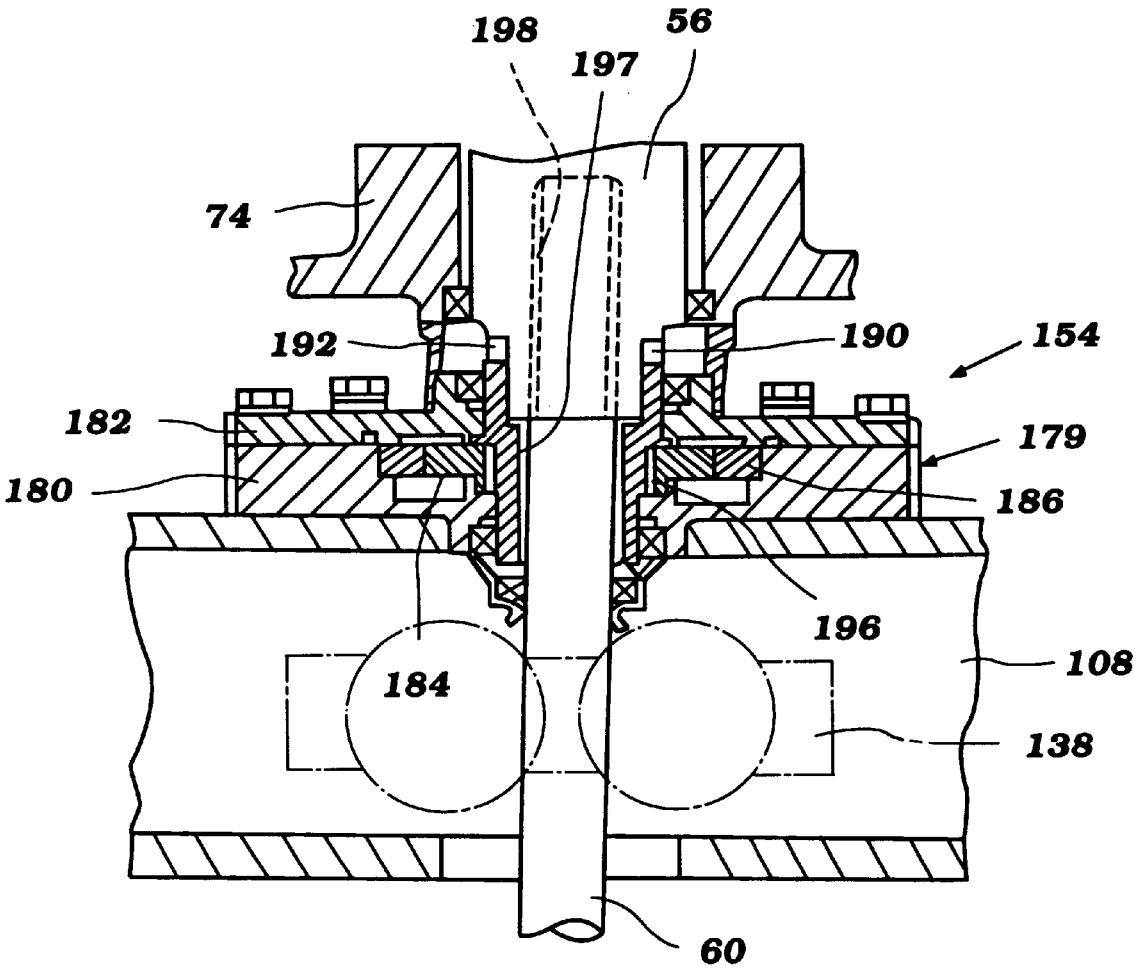
FIG. 6 is an enlarged cross-sectional side view of a portion of a motor illustrated in FIG. 2, including an exhaust guide and the oil pump.

In accordance with the present invention, there is provided an improved oil pump 154 arrangement. With reference primarily to FIG. 6, the oil pump 154 preferably includes a body 179 comprising a main housing 180 having a cover plate 182 connected thereto. Preferably, the cover plate 182 is connected to the main housing 180 with bolts or similar means for removably fastening the cover plate to the housing.

The main housing 180 is mounted to a top surface of the exhaust guide 108. The main housing 180 and plate 182 cooperate to define an internal pumping chamber 183 (see FIG. 7). The oil pump 154 is preferably of the trochoidal type, and as such includes an inner gear 184 cooperating with an outer gear 186 to pump oil through the pumping chamber 183 from an inlet to an outlet thereof.

Figure 7:
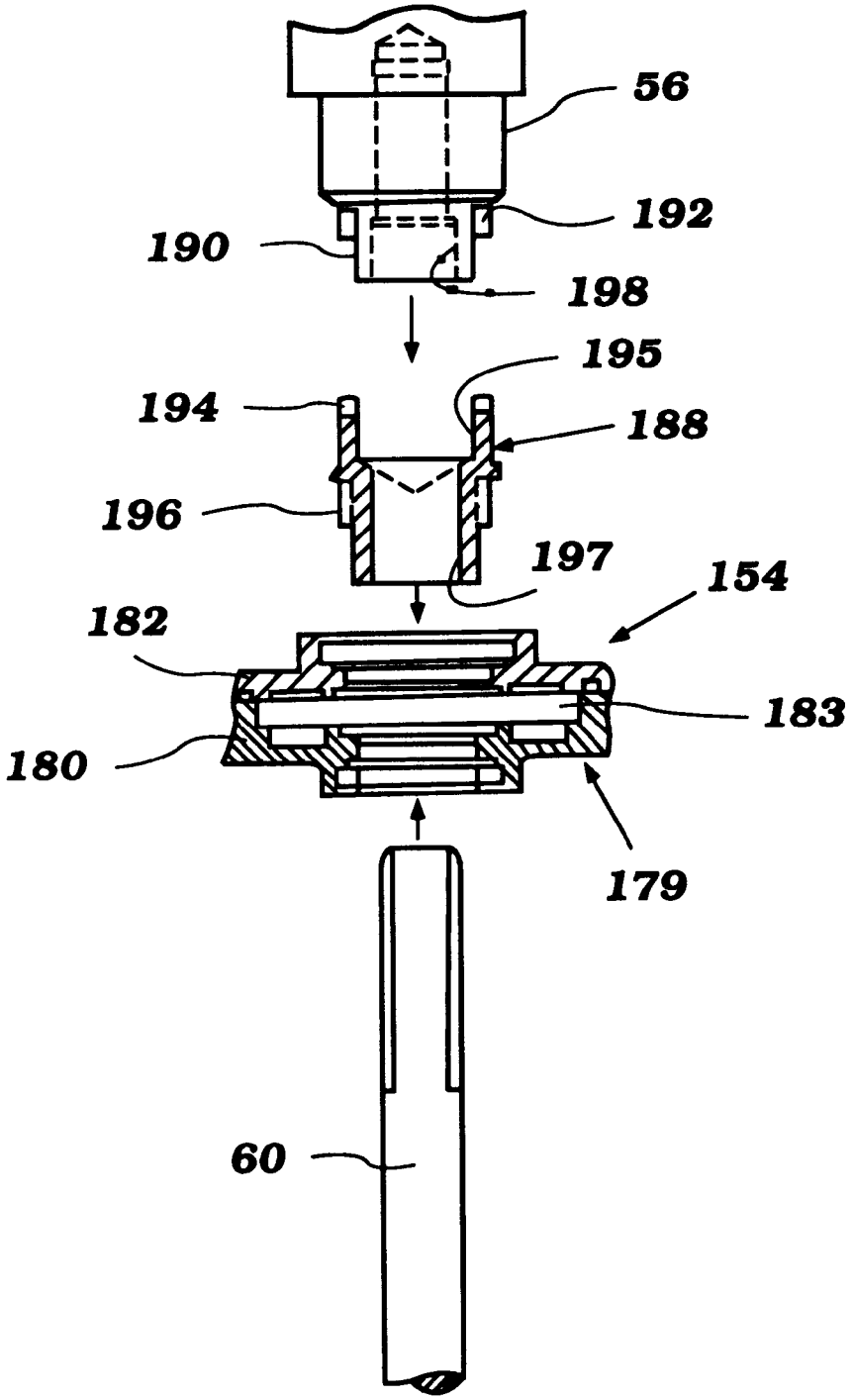
FIG. 7 is an exploded view of an oil pump drive arrangement of the oil pump illustrated in FIG. 6.

Means are provided for powering the oil pump 154. Preferably, the pump 154 is powered by the crankshaft 56 of the engine 22. Referring to FIGS. 6 and 7, the crankshaft 56 is arranged to drive the oil pump 154 through a connecting part or drive sleeve 188. In addition, the oil pump 154 is arranged so that the drive shaft 60 extends therethrough into engagement with the crankshaft 56, the drive shaft 60 extending through the drive sleeve 188.

The housing 180 and plate 182 of the oil pump 154 cooperate to define an aligned passage therethrough. The oil pump 154 is positioned on the top surface of the exhaust guide 108 so that this passage is aligned with the crankshaft 56 and drive shaft 60. Referring to FIG. 7, the crankshaft 56 has a tapered end section 190 having one or more tabs or ears 192 extending therefrom. Each ear 192 is arranged to engage a corresponding slot 194 in a top end of the drive sleeve 188.

As illustrated, the drive sleeve 188 is generally cylindrical in shape, having an outer wall which defines a passage therethrough. A top part of the drive sleeve 188 defines a passage portion 195 sized so that the tapered end section 190 of the crankshaft 56 fits therein. The drive sleeve 188 then defines a narrower passage portion 197 which is sized to prevent the passage of the crankshaft 56 therethrough, but which permits passage therethrough of the drive shaft 60, as described in more detail below.

When engaged, the drive sleeve 188 extends into the passage defined by the housing 180 and cover 182 of the oil pump 154. The drive sleeve 188 has one or more splines or ears 196 extending from the outer surface of the wall thereof. These ears 196 are arranged to engage the inner gear 184 of the oil pump 154. In this manner, rotation of the crankshaft 56 effectuates rotation of the drive sleeve 188, which in turn effectuates movement of the inner gear 184 of the pump 154 with respect to the outer gear 186 for use in pumping oil.

In addition, the end of the crankshaft 56 has a passage 198 extending upwardly therein from its lower end. The passage 198 is sized to accept a top end of the drive shaft 60, as illustrated in FIG. 6. Preferably, the passage 198 is grooved for interlocking with rib members on the exterior of the drive shaft 60, whereby rotation of the crankshaft 56 effectuates rotation of the drive shaft 60.

Figure 8:
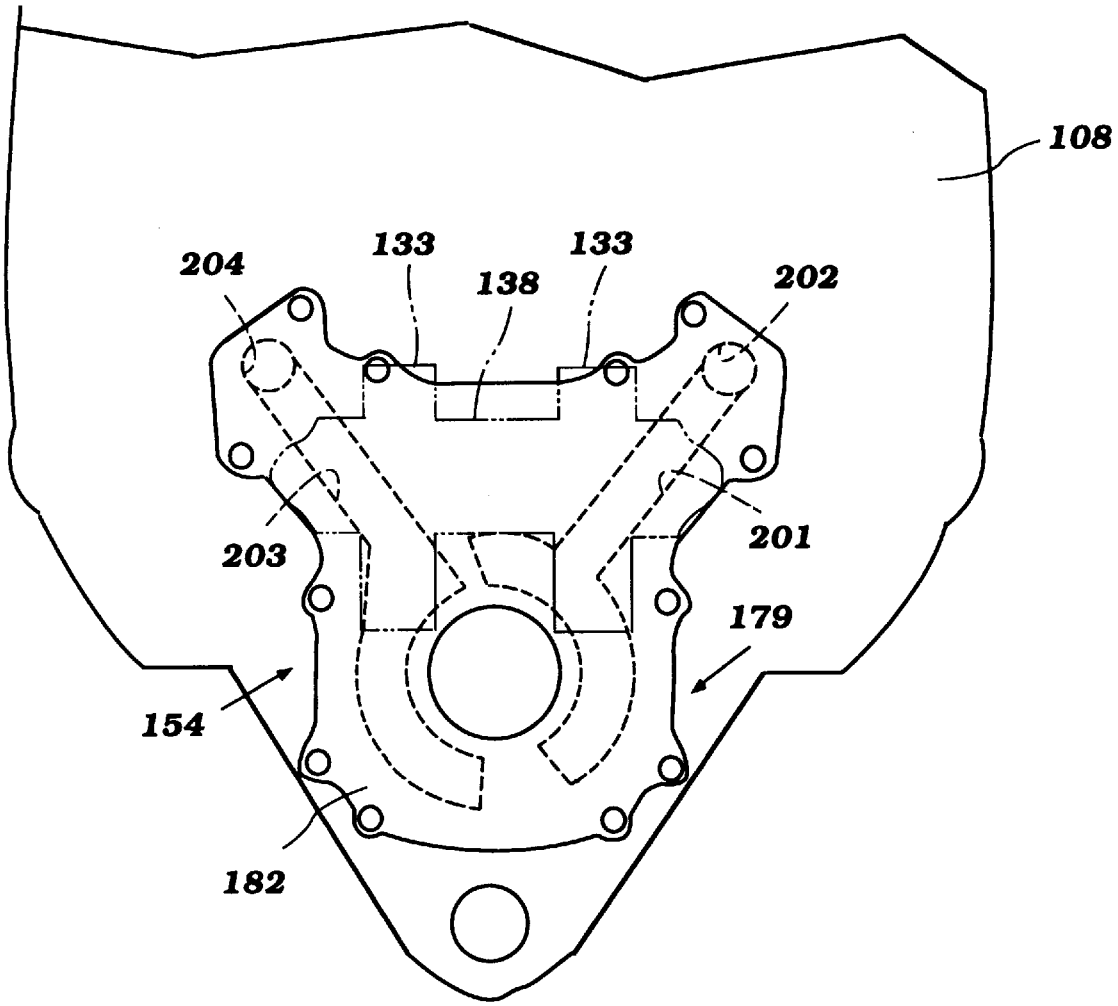
FIG. 8 is a top view of the exhaust guide and oil pump as illustrated in FIG. 6 and defining a first lubricant flow path.

Referring to FIGS. 3, 5 and 8, the flow path of lubricant from the tank 152 to the delivery passage 162 will be described in detail. Preferably, the lubricant which is drawn through the pickup 160 flows through an inlet passage 200 which extends through the exhaust guide 108. This passage 200 leads to an inlet 202 at a bottom surface of the oil pump housing 180. The inlet 202 corresponds to a pumping passage 201 of the oil pump 154. The oil pump 154 delivers lubricant through a delivery passage 203 having an outlet 204 at the bottom surface of the housing 180. This outlet 204 is aligned with a passage 206 defined by the exhaust guide 108. As illustrated, the passage 206 leads from the outlet 204 downwardly, then laterally through the guide 108, and the vertically up to the delivery passage 162 through the cylinder block 52.

As illustrated in FIG. 8, and in accordance with this first arrangement of the first embodiment of the invention, the inlet 202 and outlet 204 of the oil pump 154 are separate by a substantial distance, and the inlet passage 200 and delivery passage 203 extend with respect to one another in generally a "V"-orientation. The inlet 202 and outlet 204 are positioned to the outside of the rod sections 133 of the handle 132.

This embodiment of the invention has the advantage that the oil pump 154 is driven by the crankshaft 56 of the engine 22 at high speed, permitting the oil pump 154 to be small in size. In addition, the positioning of the pump 154 as illustrated does not generally increase the size of the engine 22, thus permitting the engine to be positioned in a small cowling 30.

Also, the pump 154 is arranged to draw oil through a rather easily formed intake passage 200 through the guide 108 from the oil pan 152 positioned directly therebelow. In addition, the oil outlet from the pump to the engine 22 is simply formed through the guide 108 and aligns directly with the passage 162 leading through the engine 22 at the abutment of the engine 22 with the guide 108. In this manner, the construction of the engine 22 is simplified.

Figure 9:
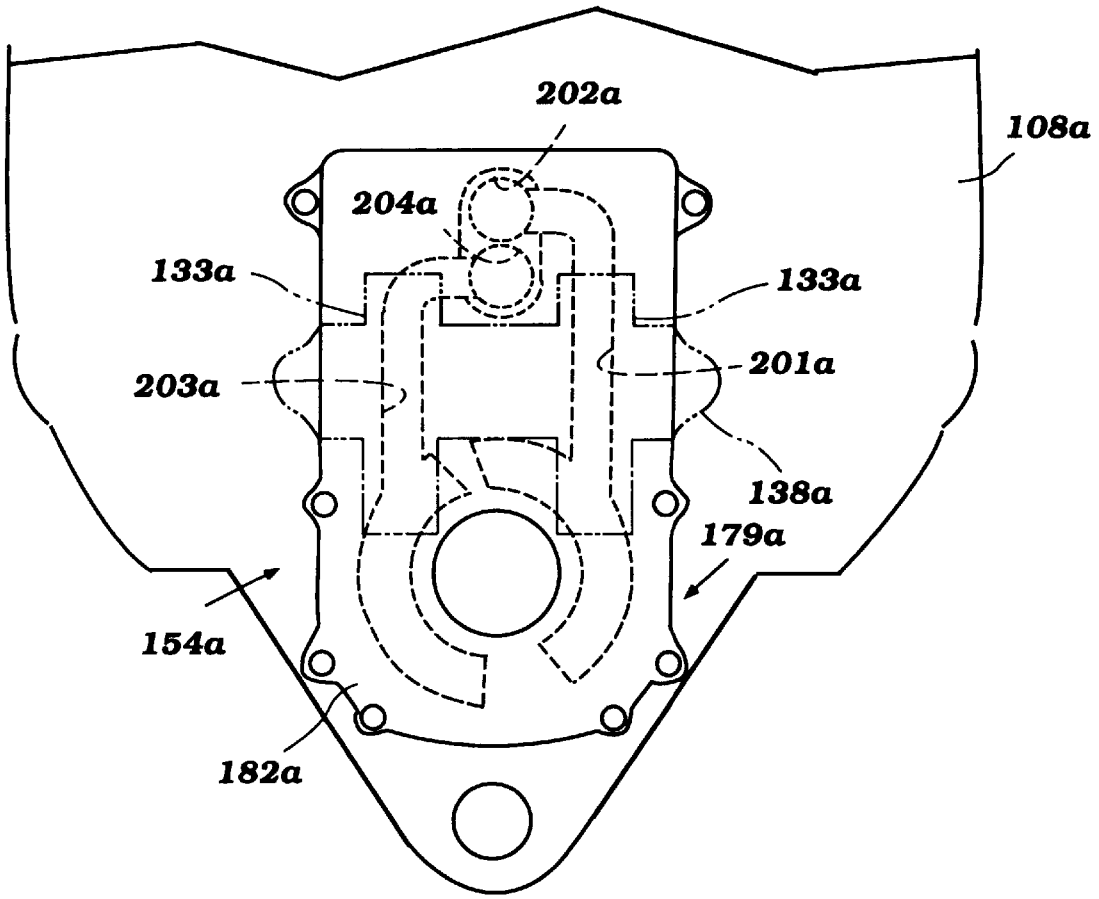
FIG. 9 is a top view of an exhaust guide and oil pump arranged with a second lubricant flow path.
Figure 10:
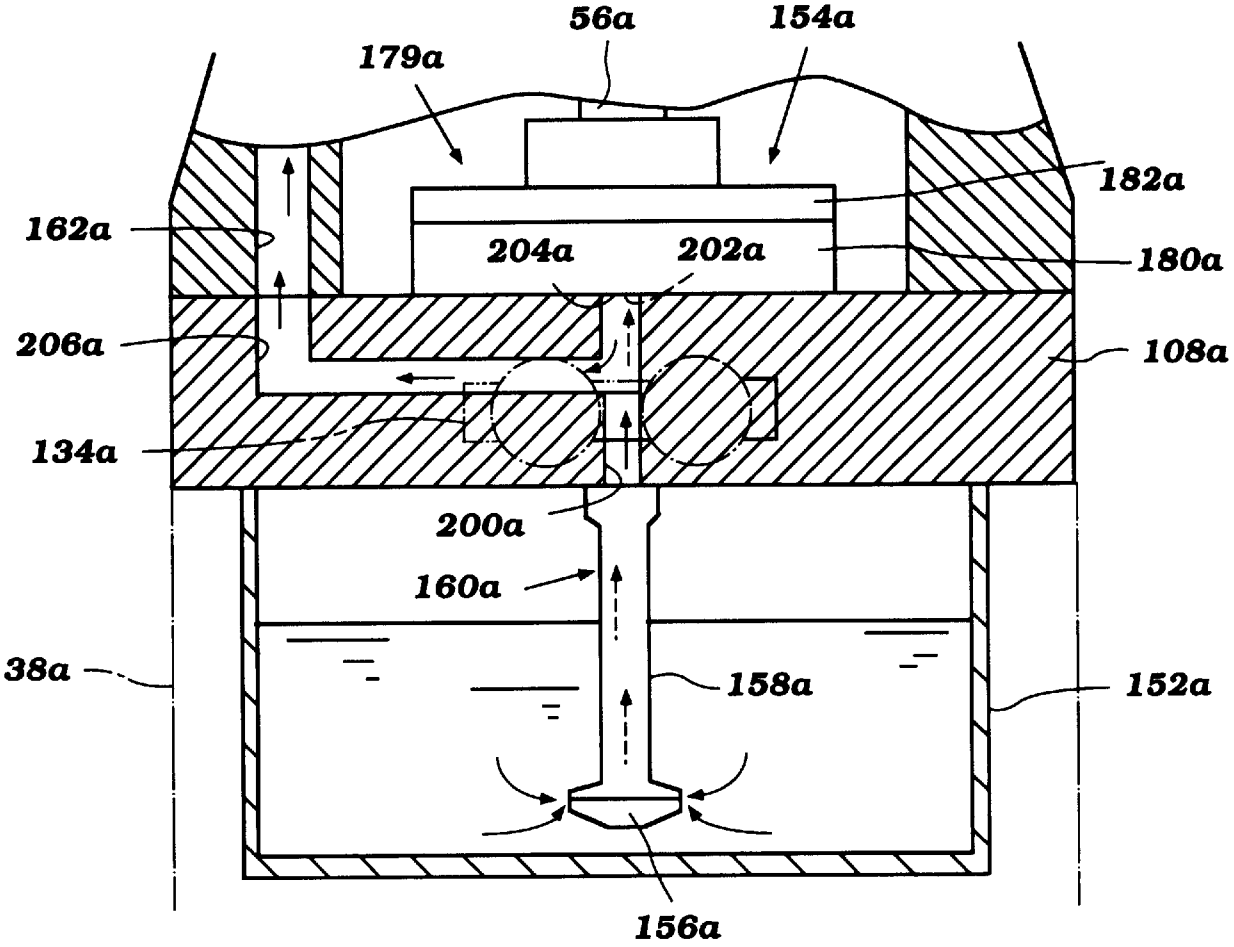
FIG. 10 is an enlarged cross-sectional side view of the exhaust guide and oil pump illustrated in FIG. 9.

A second arrangement for an oil pump 154*a* in accordance with this embodiment of the invention is illustrated in FIGS. 9 and 10. In the description and illustration of this arrangement, like reference numerals have been used with like or similar parts to those used in conjunction with the previous arrangement, except that an "a" designator has been added to all of the reference numerals herein.

In this embodiment, the inlet 202*a* and outlet 204*a* of the oil pump 154*a* are positioned adjacent one another and generally along a line which passes therethrough and through the crankshaft 56*a*. In this arrangement, the inlet passage 200*a* through the exhaust guide 108*a* extends in a straight line upwardly from the oil pickup 160*a* to the inlet 202*a*. This arrangement is advantageous since it simplifies the construction of the oil pickup 160*a*, eliminating the leg portion (element 157 in the prior embodiment).

It is desirable to centrally locate the oil pickup 160*a* within the pan 150*a*. Because the inlet 202*a* in this embodiment is generally centrally located above the oil pan 150*a*, the oil pickup 160*a* may extend generally vertically down from the passage 200*a* leading through the guide 108*a* from the inlet 202*a* and be centrally positioned in the pan 150*a*.

In this arrangement, the inlet 202*a* and outlet 204*a* are positioned in a front-to-rear direction from one another between the rod sections 133*a* of the handle 132*a*.

Figure 11:
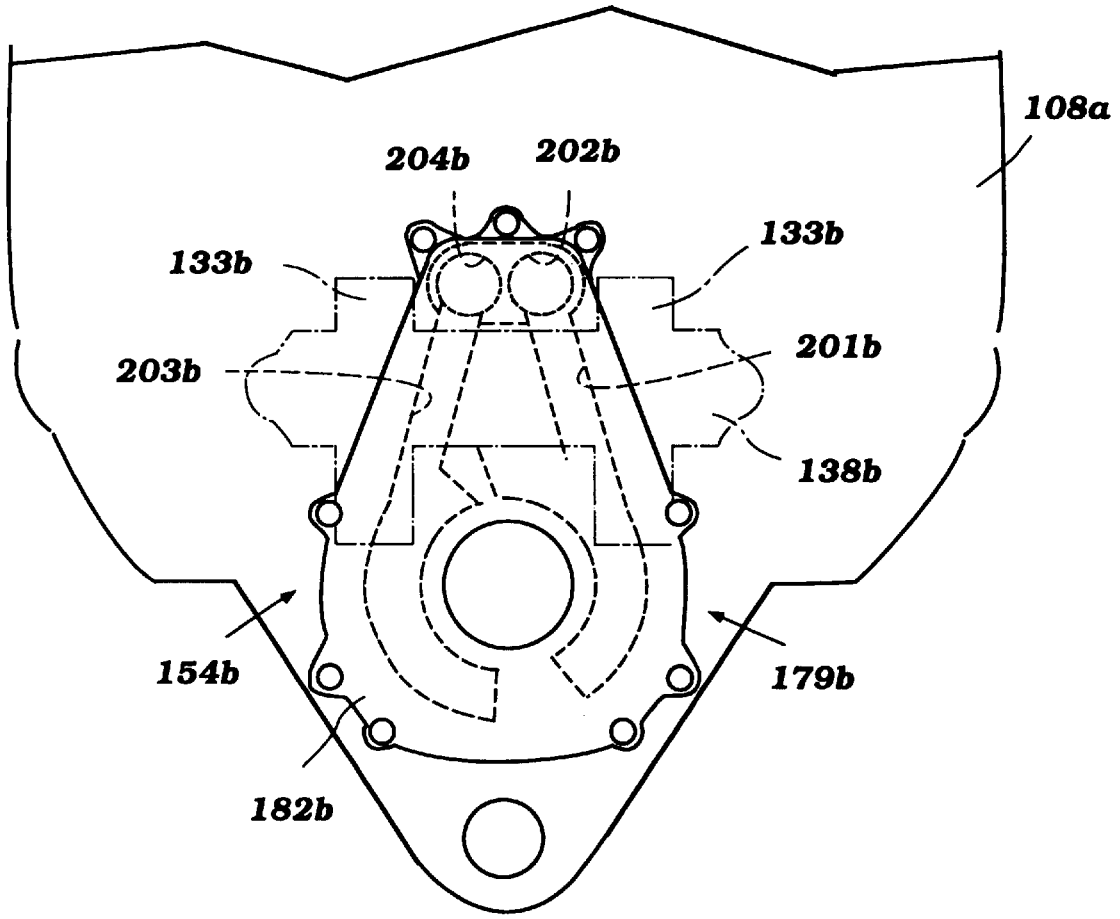
FIG. 11 is a top view of an exhaust guide and oil pump arranged with a third lubricant flow path.
Figure 12:
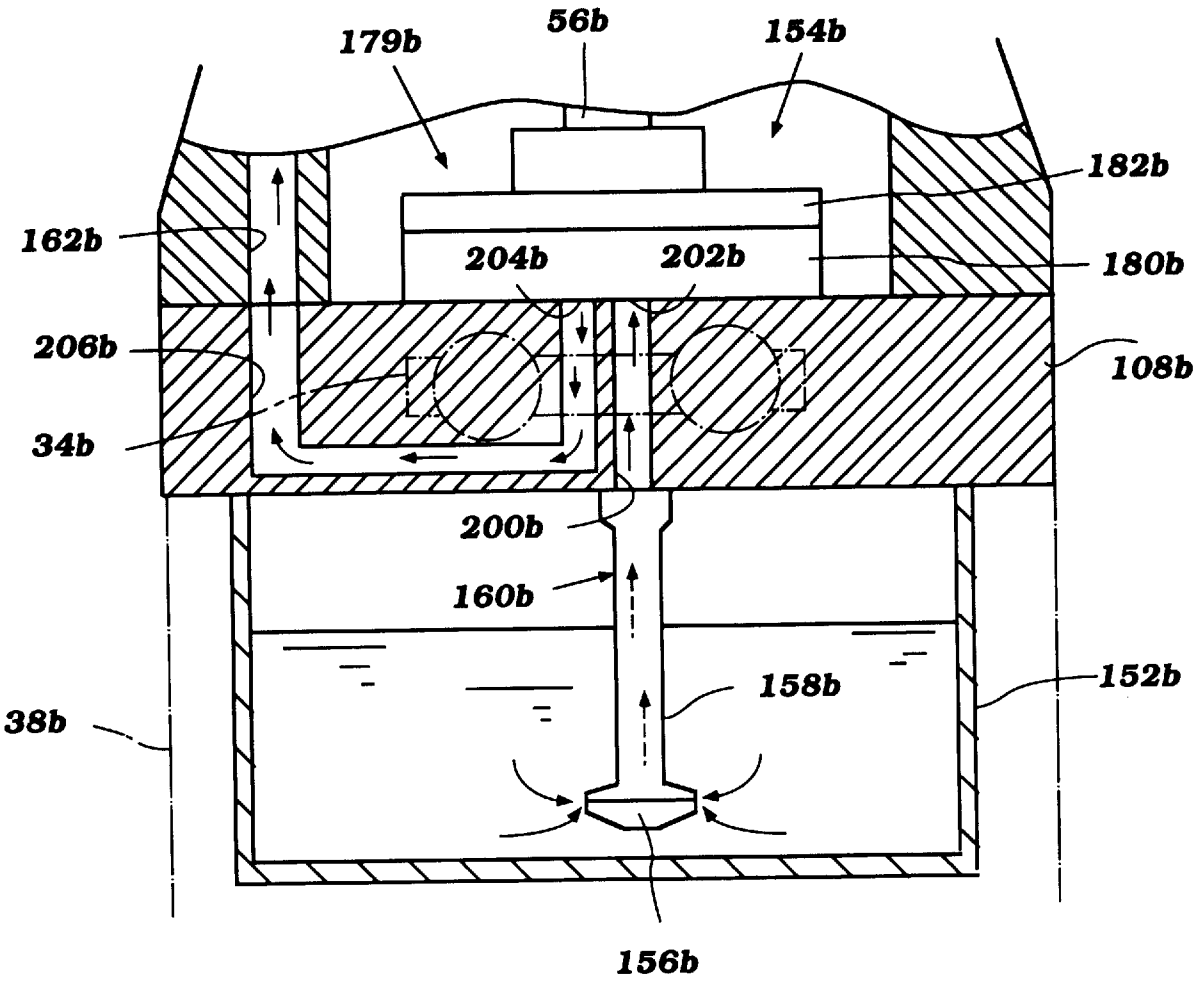
FIG. 12 is an enlarged cross-sectional side view of the exhaust guide and oil pump illustrated in FIG. 11.

A third arrangement for an oil pump 154*b* in accordance with this embodiment of the invention is illustrated in FIGS. 11 and 12. In the description and illustration of this arrangement, like reference numerals have been used with like or similar parts to those used in conjunction with the previous arrangements, except that a "b" designator has been added to all of the reference numerals herein.

In this arrangement, the inlet 202*b* and outlet 204*b* are positioned side-by-side. The inlet 202*b* is again generally positioned centrally over the oil pan 150*b*, permitting the oil pickup 106*b* to extend vertically down from the passage 200*b* through the guide 108*b*. In addition, the inlet 202*b* and outlet 204*b* are positioned in side-by-side arrangement between the rod portions 133*b* of the handle 132*b*.

Figure 13:
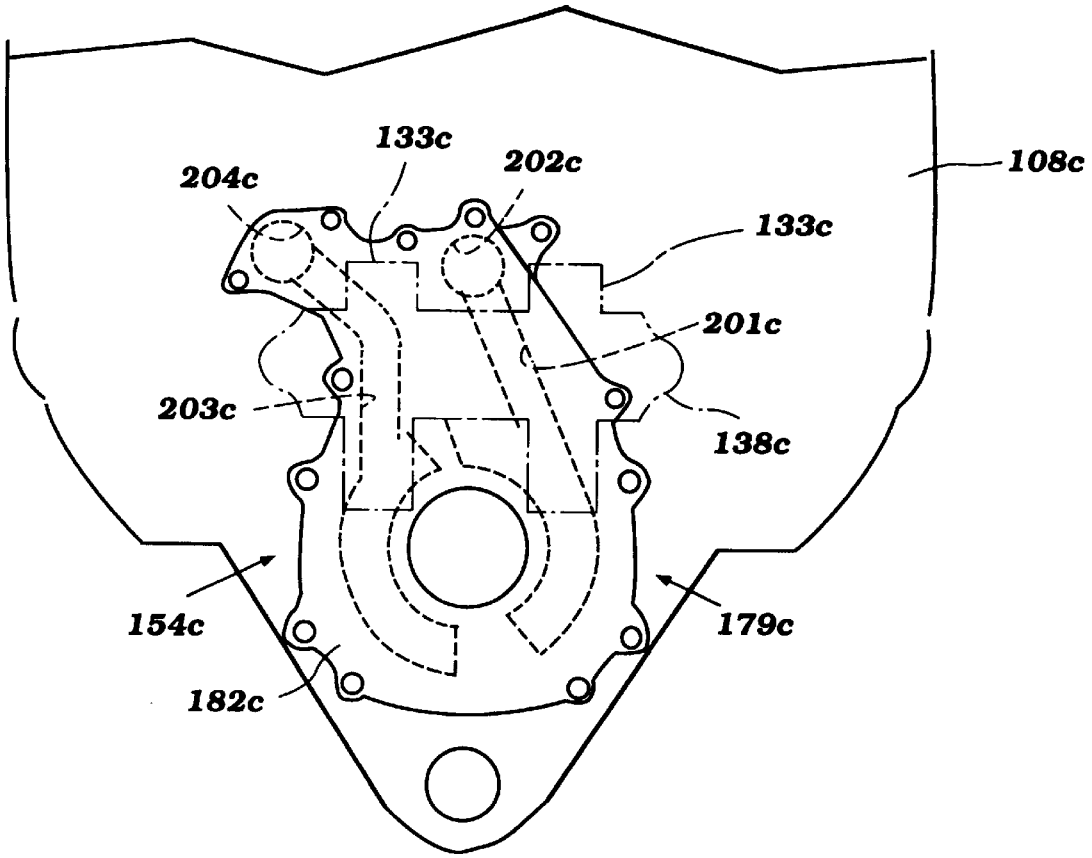
FIG. 13 is a top view of an exhaust guide and oil pump arranged with a fourth lubricant flow path.
Figure 14:
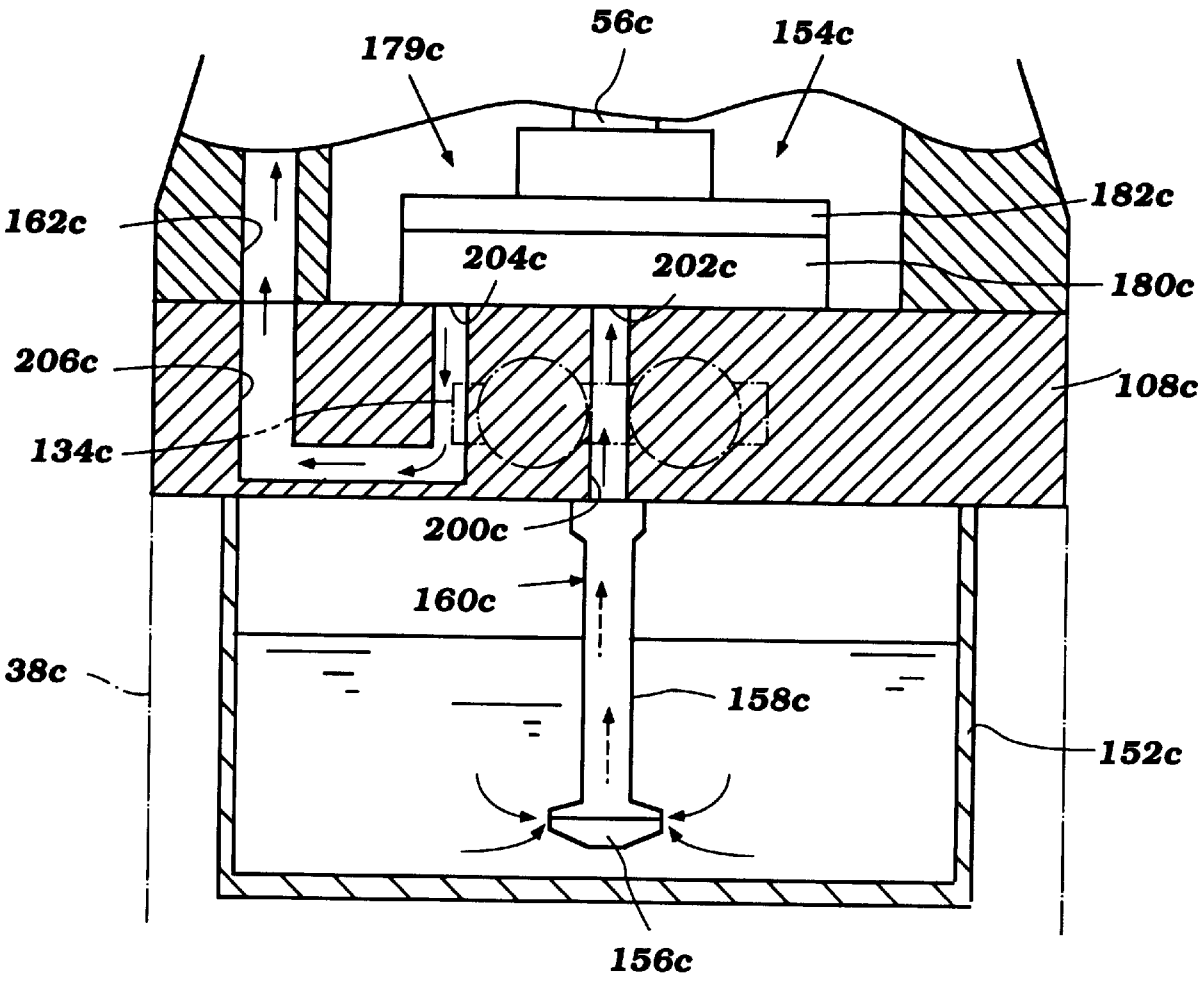
FIG. 14 is an enlarged cross-sectional side view of the exhaust guide and oil pump illustrated in FIG. 13.

A fourth arrangement for an oil pump 154*c* in accordance with this embodiment of the invention is illustrated in FIGS. 13 and 14. In the description and illustration of this arrangement, like reference numerals have been used with like or similar parts to those used in conjunction with the previous arrangements, except that a "c" designator has been added to all of the reference numerals herein.

In this arrangement, the inlet 202*c* is arranged directly above the oil pan 150*c*, permitting the oil pickup 160*c* to extend directly vertically down from the guide 108*c*. The inlet 202*c* is positioned between the rod portions 133*c* of the handle 132*c*, while the outlet 204*c* is spaced to one side of the rod portions 133*c*.

Figure 15:
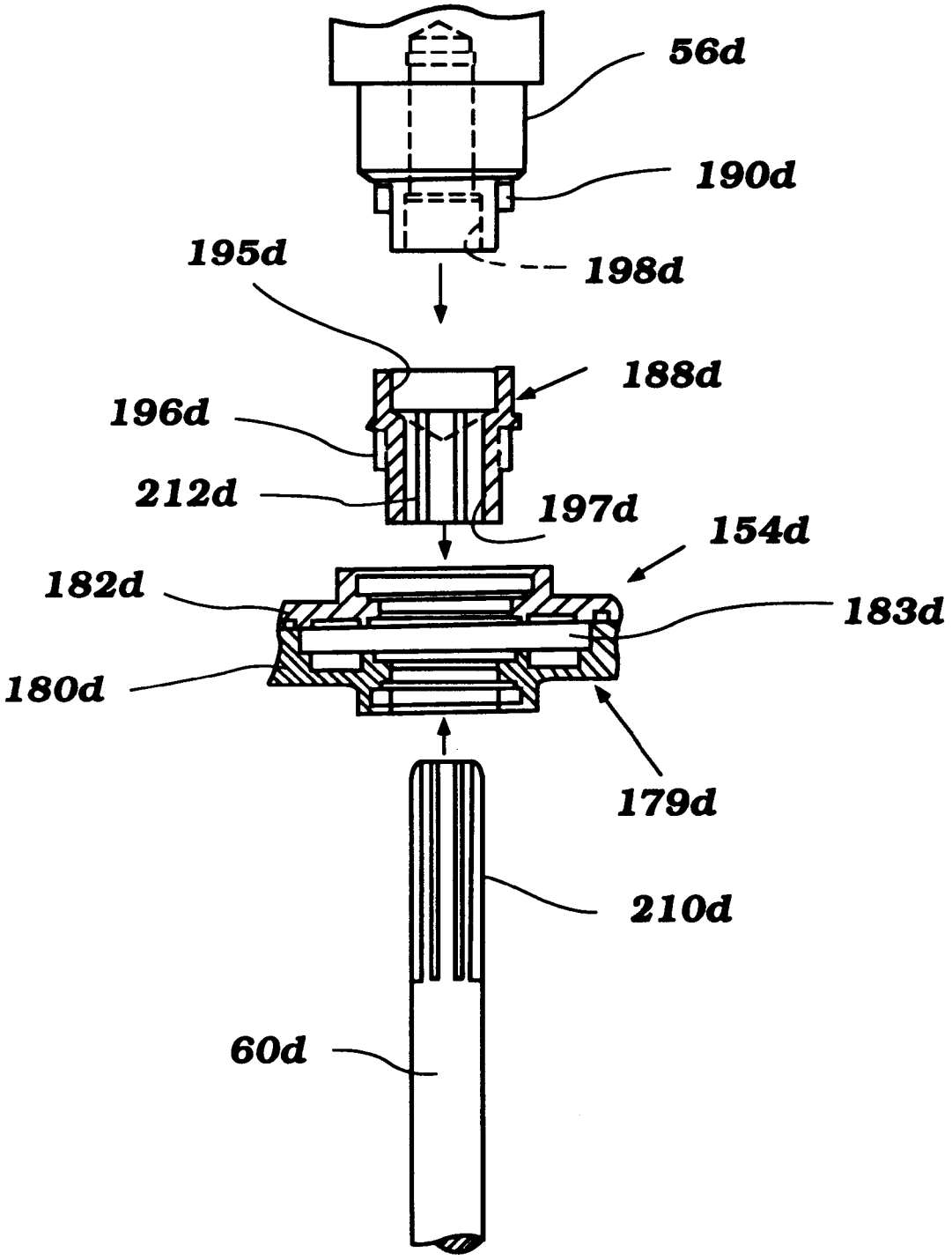
FIG. 15 is an exploded view of an oil pump drive arrangement of an oil pump in accordance with a second embodiment of the present invention.

An oil pump 154*d* arrangement in accordance with a second embodiment of the present invention is illustrated in conjunction with FIG. 15. In the description and illustration of this embodiment, like reference numerals have been used with like or similar parts to those used in conjunction with the previous embodiment, except that a "d" designator has been added to all of the reference numerals used in the description and illustration of this embodiment.

This embodiment of the invention is similar to that illustrated in FIGS. 1–8, but illustrates use of a spline connection between a drive shaft 60*d* and the drive sleeve 188*d*. In particular, a number of ribs 212*d* or splines on an end of the drive shaft 60*d* are arranged to engage with corresponding slots 212*d* in the passage 197*d* defined through the drive sleeve 188*d*.

Figure 16:
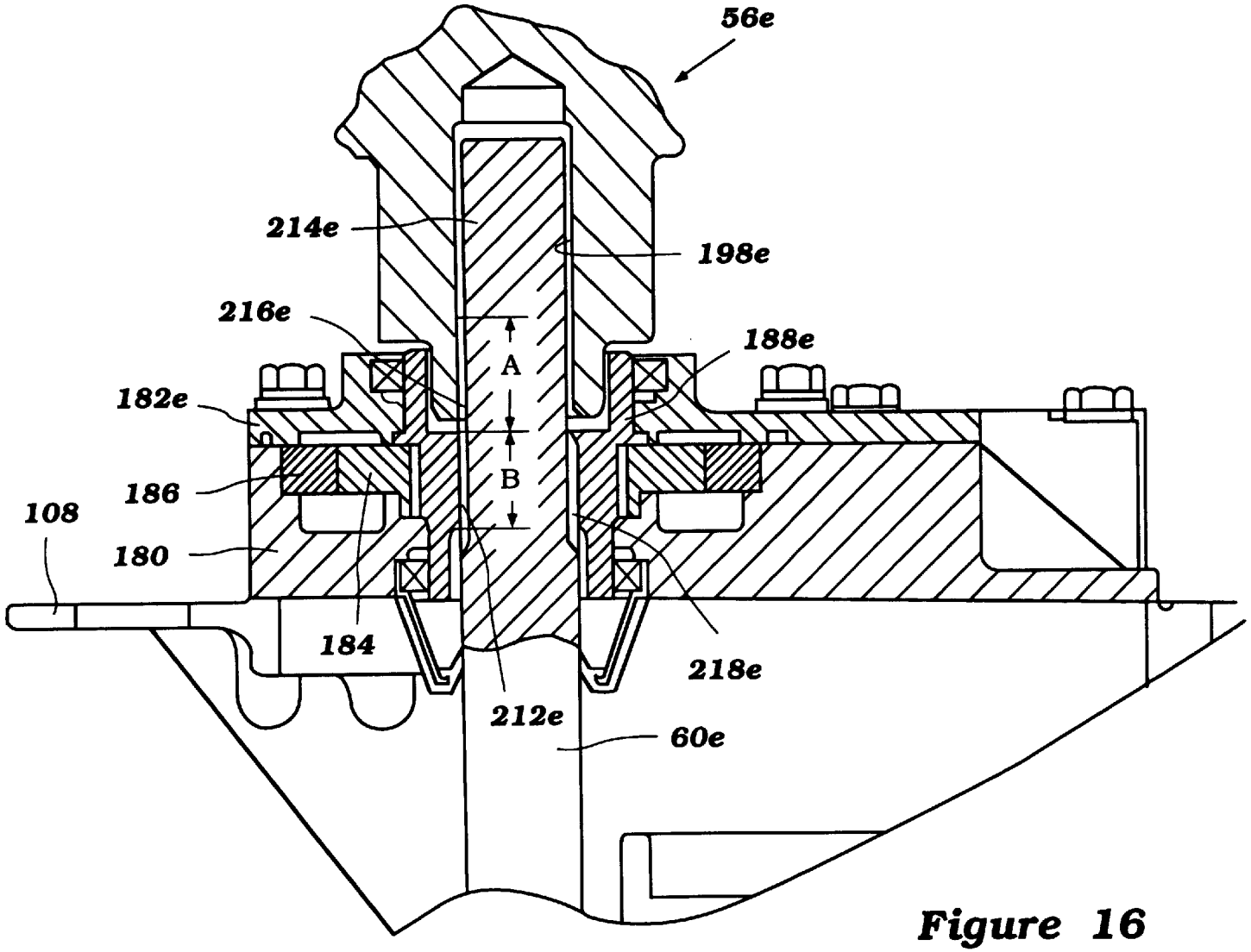
FIG. 16 is an enlarged cross-sectional side view of the drive and oil pump in accordance with a third embodiment of the present invention.

An oil pump 154*e* arrangement in accordance with a third embodiment of the present invention is illustrated in conjunction with FIG. 16. In the description and illustration of this embodiment, like reference numerals have been used with like or similar parts to those used in conjunction with the previous embodiments, except that an "e" designator has been added to all of the reference numerals used in the description and illustration of this embodiment.

In this embodiment, the drive shaft 60*e* engages the crankshaft 56*e* and drive sleeve 188*e* in splined engagement in a fashion similar to that illustrated in FIG. 15. The drive shaft 60*e* is formed with a first end section 214*e*, waist section 216*e* and drive sleeve engaging section 218*e*. The first end section 214*e* and drive sleeve engaging section 218*e* are each formed with splines for engagement with mating splines 198*e* of the crankshaft 56*e* and mating splines 212*e* of the drive sleeve 188*e*, respectively.

Further, the waist section 216*e,* which is positioned between the first end section 214*e* and drive sleeve engaging section 218*e,* is formed with a smaller maximum diameter than at least the maximum diameter of the drive sleeve engaging section 218*e*. In addition, the length of this smaller diameter waist section 216*e* is preferably of a length "A" which is greater than the length of the drive shaft engaging section 218*e,* which has a length "B."

In accordance with this embodiment of the invention, if an exceedingly high torque or force is applied to the drive shaft 60*e* or crankshaft 56*e,* the drive shaft 60*e* is arranged to twist or break in the waist section 216*e* instead of breaking within the crankshaft 56*e* or drive sleeve 188*e* and instead of twisting within the crankshaft 56*e* or drive sleeve 188*e* and ruining the splines thereon. In this manner, if a damaging force is applied to the drive shaft 60*e* or crankshaft 56*e,* the crankshaft 56*e* or drive sleeve 188*e* is not ruined, and the damaged drive shaft 60*e* may be conveniently removed and replaced at lower cost and effort than these other members.

Of course, the foregoing description is that of preferred embodiments of the invention, and various changes and modifications may be made without departing from the spirit and scope of the invention, as defined by the appended claims.

What is claimed is:

1. An outboard motor, said motor having a cowling defining an engine compartment in which an engine is enclosed, a water propulsion device contained at least in part within a driveshaft housing and lower unit disposed beneath said engine, an exhaust guide having an upper surface upon which said engine is supported and a lower surface extending across an upper portion of said driveshaft housing and lower unit, said engine having an output shaft having a lower end extending below said engine arranged to drive said water propulsion device, an oil pump and a lubricating system for said engine, said lubricating system including an oil pan positioned below said exhaust guide and an oil passage leading from said oil pan through said exhaust guide, said oil pump positioned above said exhaust guide and below said engine, said oil pump driven by said lower end output shaft of said engine, said oil pump having an oil inlet in communication with said oil passage through said exhaust guide for drawing oil from said oil pan through said guide member.

2. The outboard motor in accordance with claim 1, wherein a connecting member is connected to said lower end of said output shaft, said connecting member connected to said oil pump for driving said oil pump.

3. The outboard motor in accordance with claim 2, wherein said oil pump has an inner gear cooperating with an outer gear to pump oil, said inner gear connected to said connecting member, whereby said output shaft drives said inner gear of said oil pump through said connecting member.

4. The outboard motor in accordance with claim 2, wherein said motor includes a drive shaft having a top end extending through said pump and connected to said connecting member and a second end extending to drive said water propulsion device, whereby said output shaft drives said drive shaft.

5. The outboard motor in accordance with claim 4, wherein said connecting member comprises a generally cylindrical body having a passage therethrough and having a first end and a second end and an inner surface and an outer surface, and wherein said output shaft extends into said passage at said first end of said connecting member.

6. The outboard motor in accordance with claim 5, wherein said outer surface of said connecting member engages said inner gear of said oil pump.

7. The outboard motor in accordance with claim 5, wherein said lower end output shaft has a recessed area therein and said top end of said drive shaft extends through said passage at said second end of said connecting member and into said recessed area in said output shaft.

8. The outboard motor in accordance with claim 7, wherein said drive shaft engages said connecting member and output shaft in splined engagement.

9. The outboard motor in accordance with claim 4, wherein said drive shaft has a first portion which engages said connecting member and a second portion adjacent to said first portion, said first portion having a maximum outer diameter which is less than a maximum outer diameter of said first portion.

10. The outboard motor in accordance with claim 9, wherein said second portion has a length which exceeds said first portion.

11. The outboard motor in accordance with claim 9, wherein said drive shaft has a third portion which engages said crankshaft, said second portion between said first portion and said third portion.

12. The outboard motor in accordance with claim 1, wherein said oil pump comprises a body mounted to said top surface of said guide member.

13. The oil outboard motor in accordance with claim 12, wherein said oil pump inlet is positioned in a lower surface of said body.

14. An outboard motor, said motor having a cowling defining an engine compartment in which an engine is enclosed, a water propulsion device contained at least in part within a driveshaft housing and lower unit disposed beneath said engine, an exhaust guide having an upper surface upon which said engine is supported and a lower surface extending across an upper portion of said driveshaft housing and lower unit and through which a drive shaft for driving said water propulsion device extends, said engine having an output shaft having a lower end extending below said engine and coupled to drive said drive shaft, an oil pump and a lubricating system for said engine, said lubricating system including an oil pan positioned below said exhaust guide, said oil pump positioned above said exhaust guide and below said engine, said oil pump driven by said lower end output shaft of said engine through the coupling to said drive shaft, said oil pump having an oil inlet in communication with said oil pan for drawing oil from said oil pan.

* * * * *

UNITED STATES PATENT AND TRADEMARK OFFICE

CERTIFICATE OF CORRECTION

PATENT NO. : 6,041,892 
DATED : March 28, 2000
INVENTOR(S) : Hitoshi Watanabe, Masanori Takahashi and Noriyoshi Hiraoka It is certified that error appears in the above-identified patent and that said Letters Patent is hereby corrected as shown below:

Column 9,
Line 45, change “guide member” to -- exhaust guide --.

Signed and Sealed this

Twelfth Day of August, 2003

JAMES E. ROGAN
*Director of the United States Patent and Trademark Office*